US005823404A

United States Patent [19]

Ronchail

[11] Patent Number: 5,823,404

[45] Date of Patent: Oct. 20, 1998

[54] BEVERAGE CAN WITH INTEGRAL POUR SPOUT

[76] Inventor: Guglielmo L. Ronchail, Corso Duca d'Aosta 7, I-10129 Torino, Italy

[21] Appl. No.: 817,983

[22] PCT Filed: Oct. 23, 1995

[86] PCT No.: PCT/EP95/04151

§ 371 Date: Apr. 25, 1997

§ 102(e) Date: Apr. 25, 1997

[87] PCT Pub. No.: WO96/13438

PCT Pub. Date: May 9, 1996

[30] Foreign Application Priority Data

Oct. 27, 1994 [IT] Italy ..... T094A0863

[51] Int. Cl.[6] ..... B65D 17/32; B65D 41/32

[52] U.S. Cl. ..... 222/535; 220/269; 220/270; 222/541.9

[58] Field of Search ..... 222/531, 535, 222/541.9; 220/269, 270

[56] References Cited

U.S. PATENT DOCUMENTS 3,473,705 10/1969 May et al. .
4,000,838 1/1977 Bogert .
4,407,425 10/1983 Combs .
5,000,337 3/1991 Im .

FOREIGN PATENT DOCUMENTS 2590552 5/1987 France .
3001999 9/1981 Germany .
86-01488 3/1986 WIPO .

*Primary Examiner*—Kevin P. Shaver

[57] ABSTRACT

The container has an end wall which is weakened along an open line defining the outline of a lid and of a corresponding hole, and a lever member which is connected to the outer face of the end wall of the container and can be operated manually to tear the wall along the weakened line and to deflect the lid thus formed from the plane of the end wall. A mouthpiece connected to the portion of the wall, which is intended to form the lid, is disposed inside the container before the wall is torn and, after the tearing, can be entrained by the lever member and by the lid through the corresponding hole formed in the wall to a position of use in which its end, which is inside the container, abuts the wall.

18 Claims, 11 Drawing Sheets

BEVERAGE CAN WITH INTEGRAL POUR SPOUT

BACKGROUND OF THE INVENTION

The present invention relates to a container, particularly for drinks.

More specifically, the invention relates to a containers of the type having:

an end wall which is weakened along an open line defining the outline of a lid and of a corresponding hole, and a lever member, which is connected to the outer face of the end wall of the container and can be operated manually to tear the wall along the weakened line and to deflect the lid thus formed relative to the plane of the end wall.

There are known drinks containers comprising sealingly interconnected containers and tops of metallic material (typically aluminium, steel, or alloys thereof).

In a first known type of container, a weakened line formed in the top defines the outline of a lid and of a corresponding hole. A lid lever connected to the portion of the top which is intended to form the lid can be operated manually to "tear" and separate the lid (and the lever) from the top of the container, opening the corresponding hole.

This known type of container has the disadvantage that, when it is opened, the tear lever and the lid are physically separated from the container and may therefore be scattered in the environment.

To prevent this problem, drinks containers of the type defined at the beginning of the present description, in which the operation of the opening lever tears the top of the container and bends the lid thereof towards the inside of the container through the corresponding hole have been proposed.

After the tearing and bending of the lid, however, the latter remains firmly connected to the container and cannot be scattered in the environment separately therefrom.

Both of the solutions described above have the disadvantage that the consumption of drinks packaged in containers with partially-open tops does not afford suitable hygienic protection. In fact, however the product is swallowed, directly from the container or by being poured into a glass, it runs over the top or over its edge, so that the precautions adopted during production and packaging to ensure the sterility of the product are rendered useless. When drinking takes place directly from the container, it is also necessary to take into account, together with the undoubted inconvenience, the further risks resulting from the contact of the lips with the rim of the top and the edge of the hole.

The second solution (described above) also has the disadvantage that, in the condition of use, the lid is "immersed" in the drink and may transfer any germs, bacteria, etc. thereto, further detracting from its hygiene.

SUMMARY OF THE INVENTION

The primary object of the present invention is to provide a container of the type defined at the beginning which overcomes these problems.

These and other objects are achieved, according to the invention, by means of a container of the type defined above, characterized in that a mouthpiece is connected to the portion of the end wall which is intended to form the lid and is disposed inside the container, beneath the wall before the end wall is torn, and, after the wall is torn, can be entrained by the lid through the corresponding hole formed in the wall to a position of use in which its end which is inside the container abuts the wall.

BRIEF DESCRIPTION OF THE DRAWINGS

Further characteristics and advantages of the invention will become clear from the detailed description which follows, purely by way of non-limiting example, with reference to the appended drawings, in which.

DETAILED DESCRIPTION OF THE INVENTION

Figure 1:
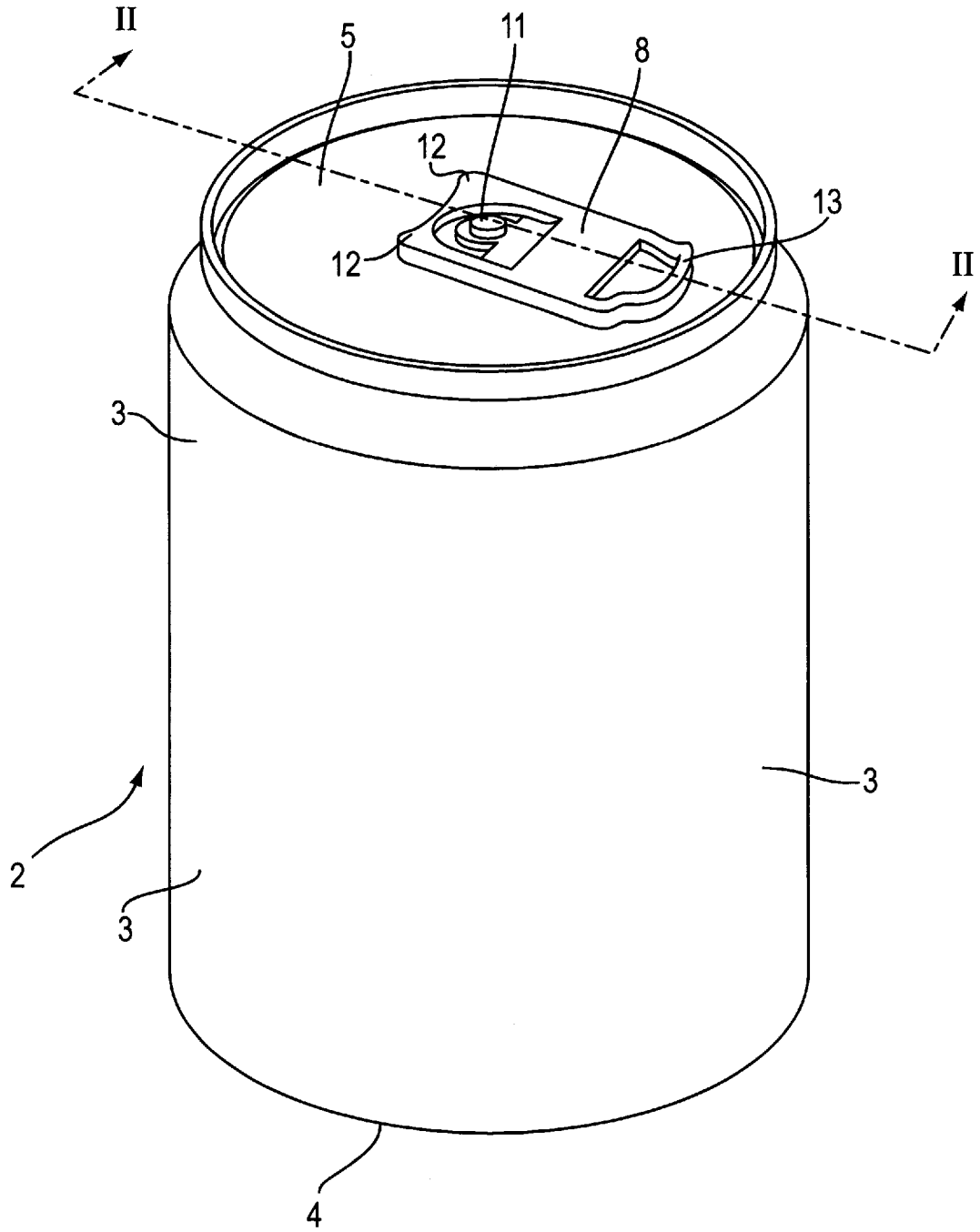
FIG. 1 is a perspective view of a container for drinks according to the invention.
Figure 2:
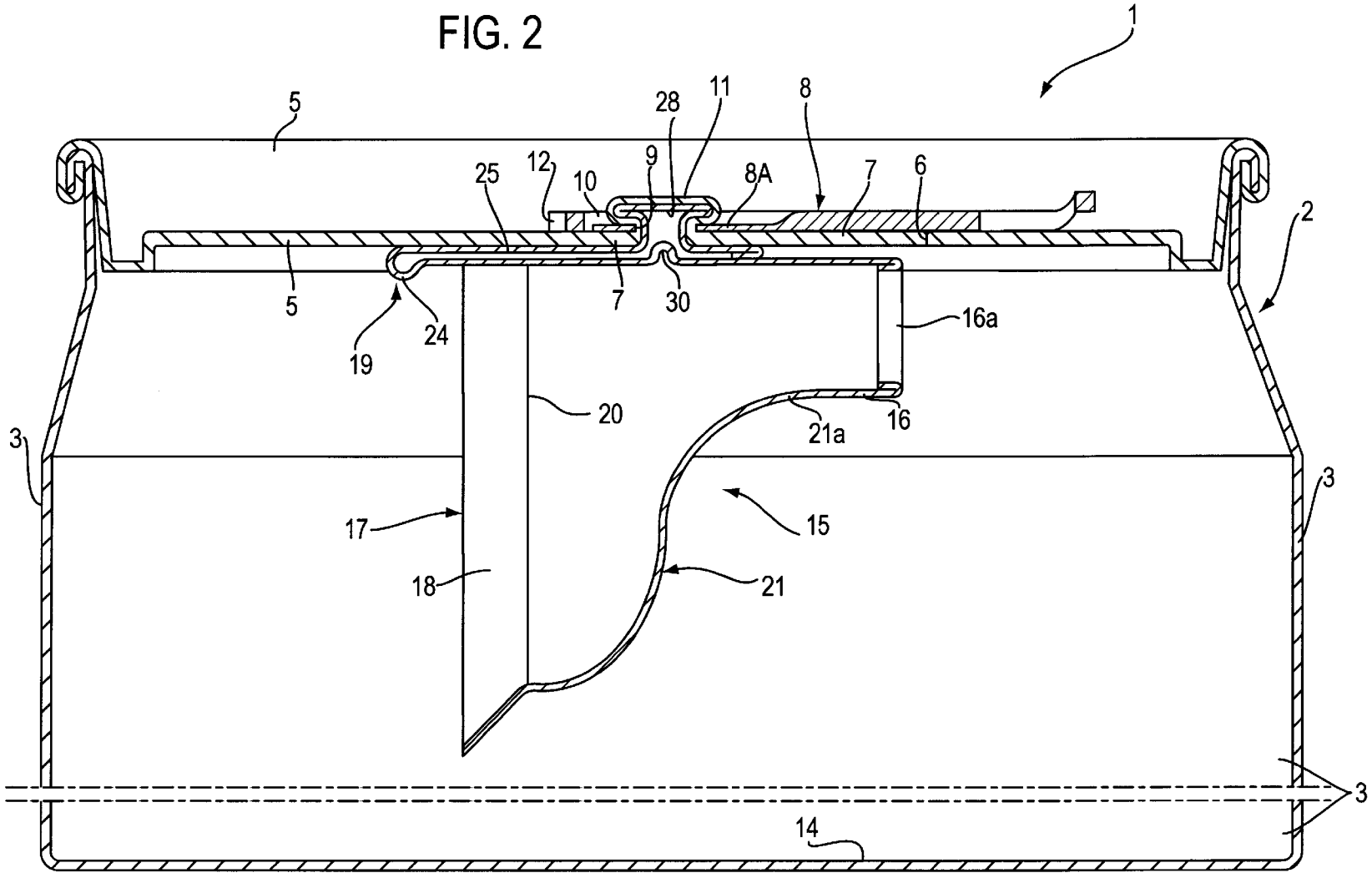
FIG. 2 is a partial view, sectioned on the line II—II of FIG. 1, on an enlarged scale.
Figure 3:
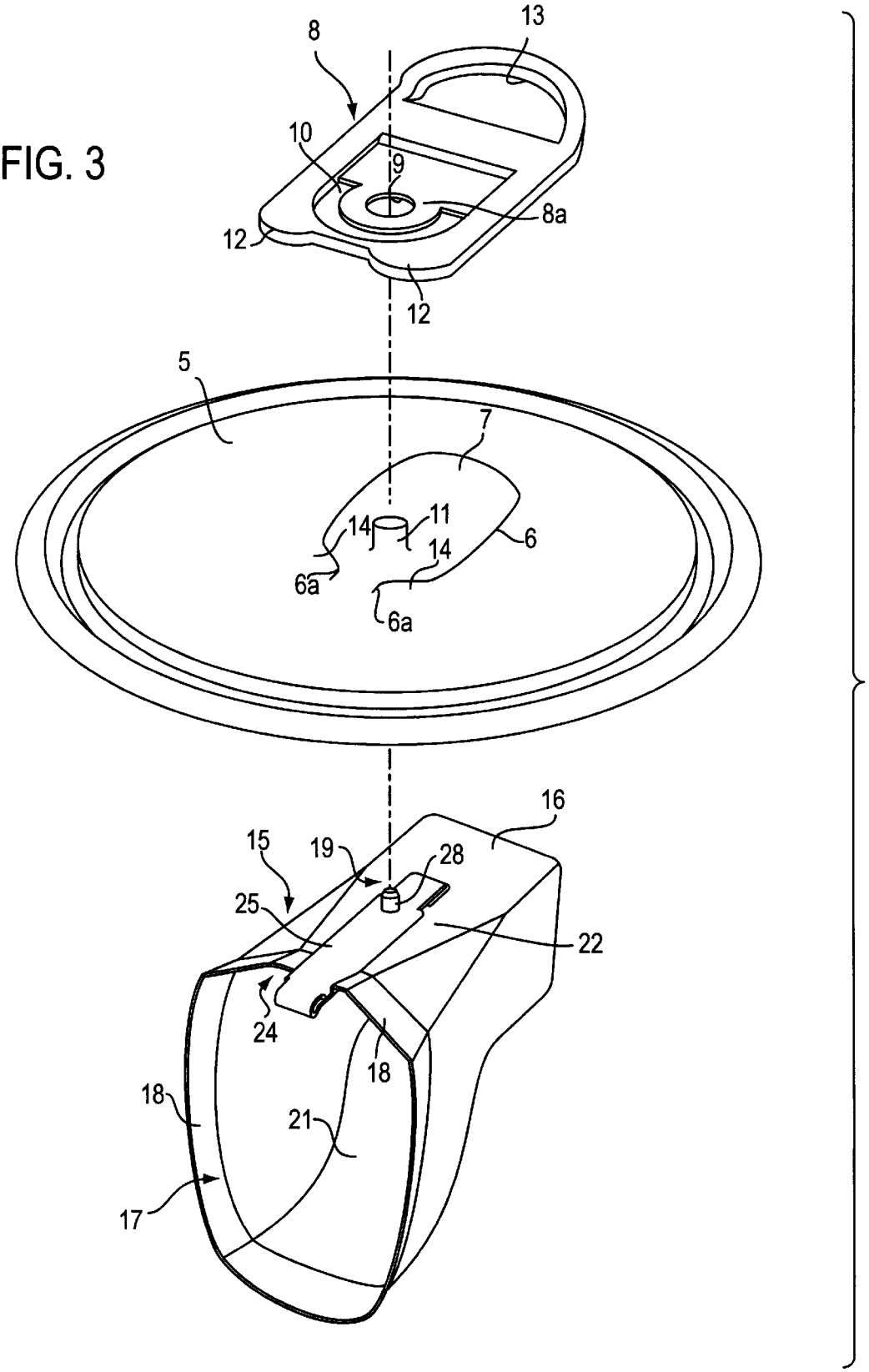
FIG. 3 is an exploded, perspective view of part of the drinks container of FIGS. 1 and 2, FIGS. 4 and 5 are perspective views of a mouthpiece included in a drinks container according to the invention, in two successive stages of manufacture.

With reference to the drawings, and in particular to FIGS. 1 to 3, in the embodiment shown by way of example, a drinks container 1 according to the invention comprises a substantially cylindrical container 2 made, for example, of aluminium, steel or an alloy thereof. The side wall 3 and the base 4 of the container are conveniently formed in a single piece by the drawing technique.

A top, generally indicated 5, also (for example) of aluminium or an alloy thereof, is sealingly connected to the upper end of the container 2 by means of a folded seam.

A coating constituted, for example, by an epoxy phenolic varnish, a vinyl organosol, or a polyester varnish may be applied to the inwardly-facing surfaces of the container 2 and of the top 5 in known manner.

As can be seen in FIG. 3, a weakened line 6 is formed on the outer face of the top 5, for example, by partial incision (semi-blanking).

The weakened line 6, which is open, encloses a portion 7 of the top 5 to the outer face of which a lever member 8 for opening the container is connected (in the manner which will be described further below).

The lever member 8 has an intermediate portion 8*a* of reduced thickness in which a hole 9 can be formed. A slit or removed portion 10 which, in the embodiment illustrated, is essentially semicircular, is defined around the portion 8*a*.

A projection 11, formed in the portion 7 of the top 5, extends through the hole 9 in the lever operating member 8 and is upset like a rivet on the other side of the hole. In FIG. 2, the projection 11 is shown in the deformed condition in which it connects the lever member 8 to the top 5 whereas, in FIG. 3, the projection is shown in the condition before it is inserted through the hole 9 in the lever member and before its plastic deformation (upsetting).

Conveniently, as can be seen from FIGS. 1 and 3, the lever member 8 covers and protects the weakened line 6 so as to prevent the top 5 from being torn or broken open along the weakened line as a result of a load parallel to the axis of the container.

In the embodiment shown by way of example in FIG. 3, the weakened line 6 has two end portions 6*a* which are close together and between which there is an end portion 7*a* of the part 7 of the top which is enclosed inside the weakened line.

The end of the lever member 8 adjacent the end portions 6*a* of the weakened line 6 has two appendages, indicated 12, which project longitudinally and preferably also towards the top 5 and which can act as pivot points in the lifting and pivoting movement of the lever member 8 during the opening of the container. The opposite end of the member 8 has a hole 13, for example a half-moon-shaped hole, for facilitating the insertion of a finger beneath the end of the lever member to open the container.

Advantageously, the lever member 8 is generally quite thick, for example, of the order of 1.2 mm thick, except for the intermediate portion 8*a* where it has a reduced thickness, for example, of the order of 0.4 mm.

The appendages 12 of the lever member 8 bear from above against respective portions 14 of the top 5, outside the weakened line 6 near the end portions 6*a* thereof (FIG. 3).

A mouthpiece, generally indicated 15, is connected to the lower face of the portion 7 of the top 5 which faces inwardly of the container. In the embodiment shown by way of example, this mouthpiece has a mouth end 16 of smaller cross-section, and an end 17 of relatively larger cross-section. In particular, this end portion 17 has a flared skirt 18 which extends substantially along its entire periphery except for a short portion from which a shaped appendage, generally indicated 19 in the drawings, extends.

In the region 20 in which the flared skirt 18 is connected to the rest of the mouthpiece 15, the mouthpiece has a cross-section of a shape substantially corresponding to the shape of the weakened line 6 in the top 5.

Between the transition region and the narrow mouth portion 16, the mouthpiece has shaped side walls. In the embodiment shown by way of example, one of these walls, indicated 21, is curved and substantially S-shaped. In particular, the portion 21*a* of this wall, which is adjacent the mouth end 16 of the mouthpiece, is concave outwardly and has a radius of curvature substantially corresponding to the mean radius of curvature of a person's lower lip (FIG. 2).

The shaped appendage 19 of the mouthpiece 15 extends from the base of its side wall portion 22 opposite the shaped wall 21. In the embodiment shown by way of example, the appendage 19 has a base portion 23 which is substantially coplanar with the wall 22, and which extends as far as a bend region indicated 24. Beyond this bend region, the appendage 19 is extended by an essentially straight portion 25 onto which two lateral laps or layers 26 and an end flap or layer 27 are folded to provide it with a desired degree of strength. These flaps or layers can be seen particularly well in FIG. 4 which shows the appendage 19 in an intermediate stage of its bending towards and against the side wall 22 of the mouthpiece.

The widths of the bent side flaps 26 are reduced in portions indicated 26*a*, the purposes of which will be explained below.

Figure 5:
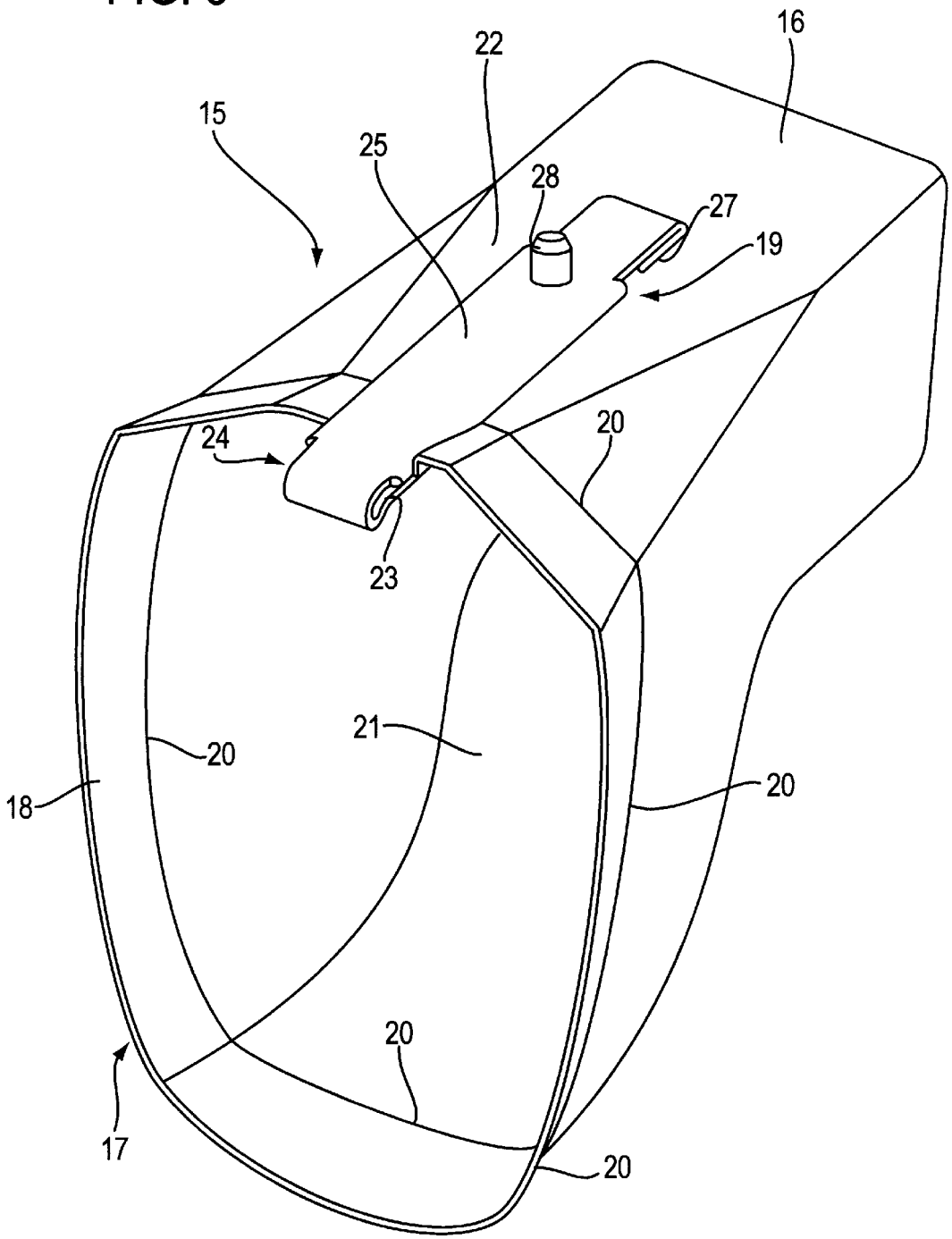

An outwardly-projecting projection 28 is advantageously formed in a region of the portion 25 of the appendage 19 which is left uncovered by the bent flaps 26 and 27, as shown in FIGS. 3 and 5, in which the appendage 19 is shown in its bent condition at the stage immediately preceding its fixing to the top 5 of the container. In particular, the projection 28 has dimensions such as to allow it to be inserted in the corresponding projection 11 in the top and to be inserted, together therewith, through the hole 9 in the lever member 8.

Figure 6:
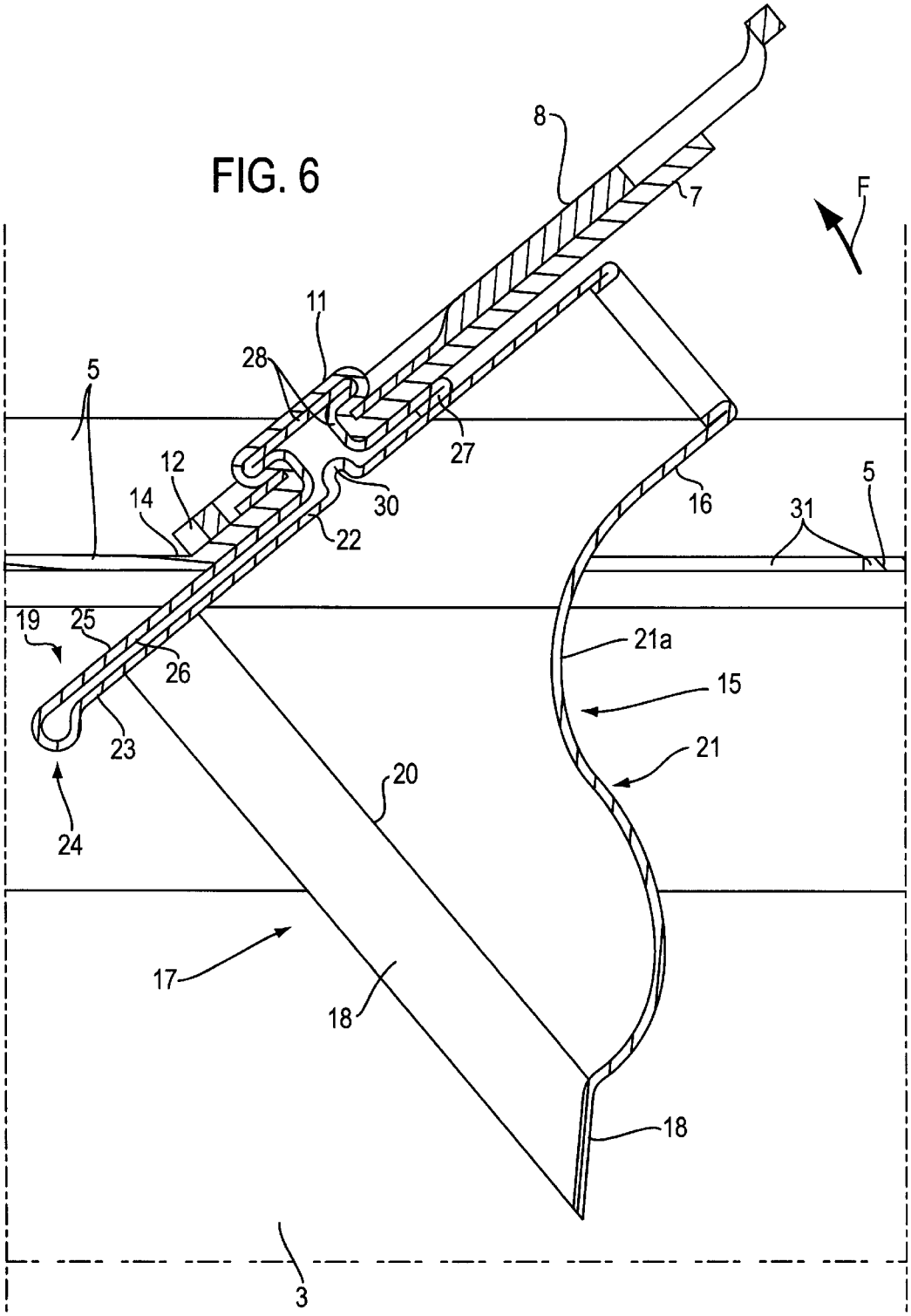
FIGS. 6 to 9 are partial, sectioned views similar to that of FIG. 2 but showing successive configurations adopted by some parts of the container according to the invention in the course of the lid of the container.

The mouthpiece 15 is fixed to the top 5 by the upsetting (plastic deformation) of the projection 11 in the top and of the projection 28 in the appendage of the mouthpiece, jointly, over the portion 8*a* of the lever member 8, as can be seen in FIGS. 2, 6 et seq., in particular.

In an alternative embodiment, the side flaps 26, 27 could entirely cover (eventually superimposed one to the other) the portion 25 in which the projection 28 is provided. In such a case, in the flaps 26, 27 there are provided, in positions corresponding to that of the projection 28, respective projections which extend into said projection 28 and which can act as "anvils" or "counter-tools" in the subsequent phase in which (as described above) the projections 28 and 11 are jointly upset.

The width of the bent appendage 19 of the mouthpiece 15 preferably corresponds to the distance between the end portions 6*a* of the weakened line 6 in the top 5.

Figure 4:
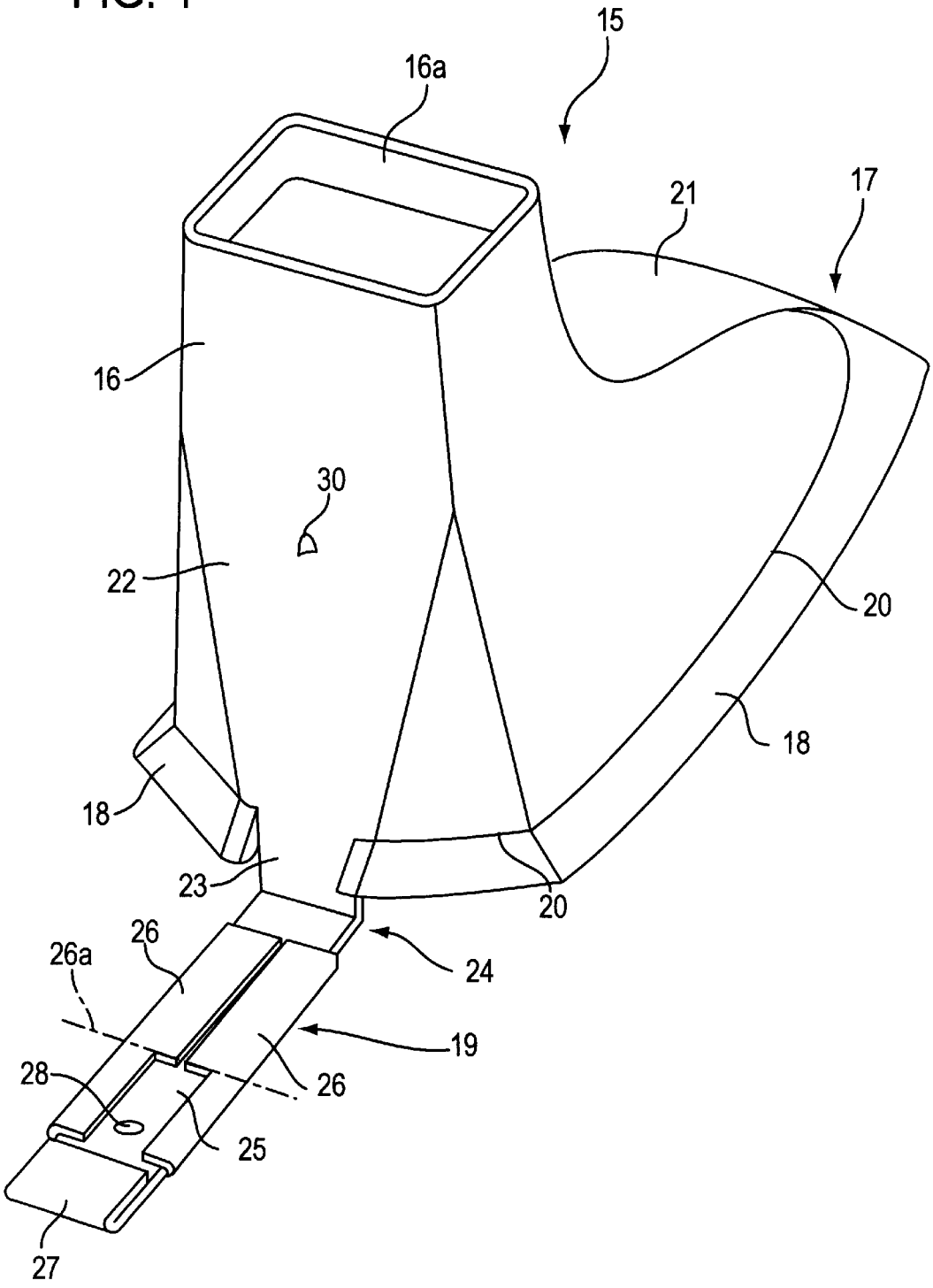

Advantageously, but not necessarily, the edge of the mouth end 16 of the mouthpiece 15 is turned inwardly as can be seen, for example, in FIGS. 2 to 4, so that it is not sharp in use.

The mouthpiece 15 described above can advantageously be made in a single piece, for example, of aluminium or steel or alloys thereof, by blanking, drawing and bending operations.

During the manufacture of the container described above, the container 2, the top 5, the lever member 8 and the mouthpiece 15 are formed separately. The mouthpiece 15 is then fixed to the top 5 and to the lever member 8 in the manner described above. During this step, a small reference indentation, such as that indicated 30 in FIG. 4 which, in the bent condition in which the appendage 19 is mounted, faces and possibly penetrates the projection 28, may advantageously be formed in the wall 22 of the mouthpiece for easier and more precise positioning of the opposing tool (the "anvil") for the joint upsetting of the projection 11 in the top 5 and of the projection 28 in the appendage of the mouthpiece 15.

The mouthpiece 15 is fixed to the top 5 in the relative position which can be inferred from FIGS. 2, 3, 6, et seq.

Once the mouthpiece 15 has been fixed to the top, the latter is coupled to the end edge of the container 2, for example, by means of a folded seam, in known manner.

In the condition of use, the container described above is as shown in FIGS. 1 and 2.

In order to open the container 1 so as to be able to drink from it directly or in order to pour out the drink it contains, the user lifts the lever member 8 at its end having the hole 13. The lever member pushes on the portions 14 of the top 5 with its appendages 12, which act essentially as pivot points (FIG. 3), and exerts a pulling force on the portion 7 of the top by means of the projection 11 which is upset onto the lever member. As a result of the operation of the lever member 8 in the sense of the arrow F of FIG. 6, the lever member tears the top 5 along the weakened line 6 thus forming a lid 7 and a hole of corresponding profile, indicated 31 in FIGS. 6 to 9. The lid 7, however, remains connected to the rest of the top 5 by its portion 7*a* which is disposed between the end portions 6*a* of the tear line 6.

Figure 7:
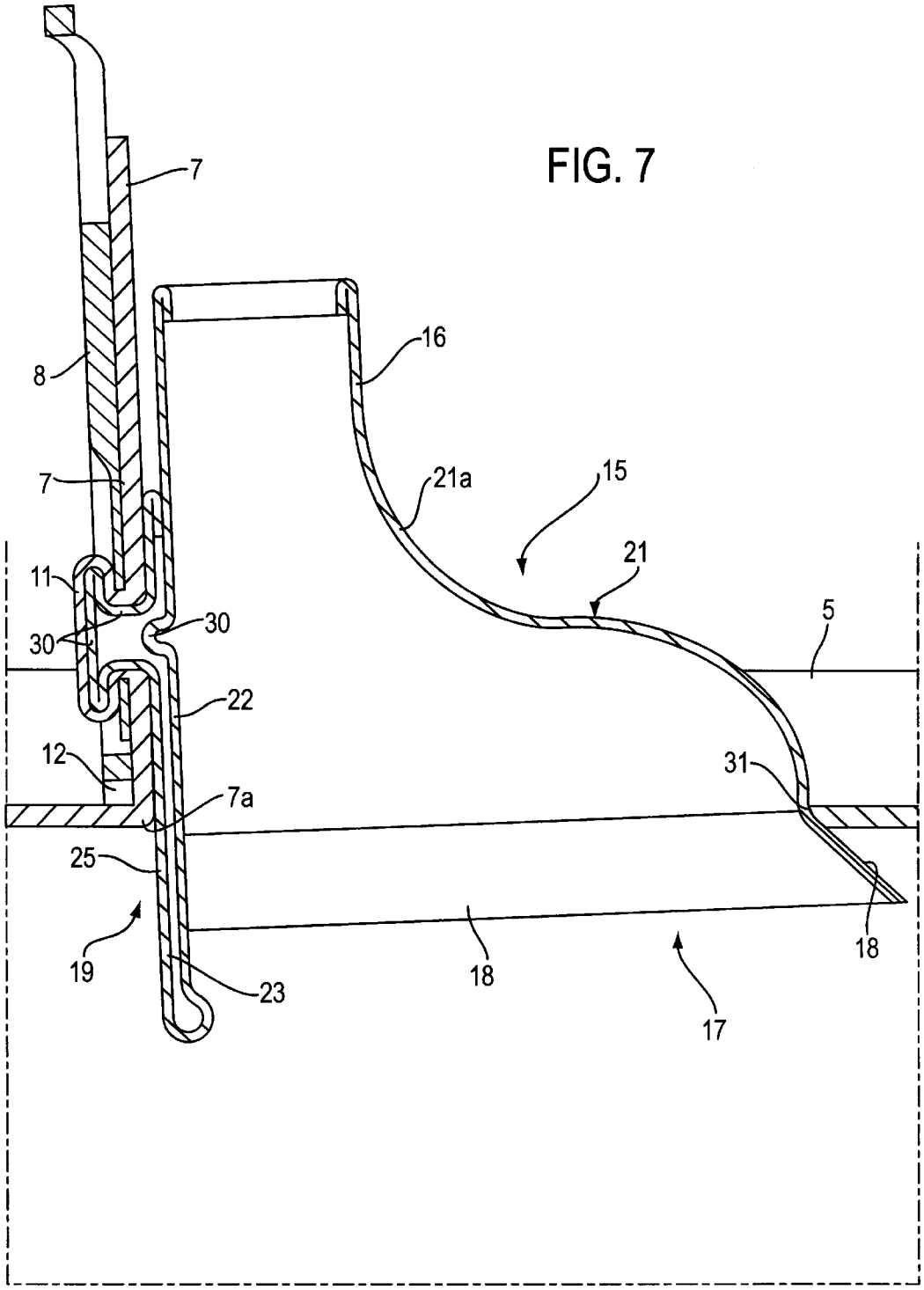

The lifting and pivoting of the lever member 8 involves a corresponding pivoting of the mouthpiece 15 connected thereto, as can be seen, in particular, in FIGS. 6 and 7 which show two successive positions thereof.

Figure 8:
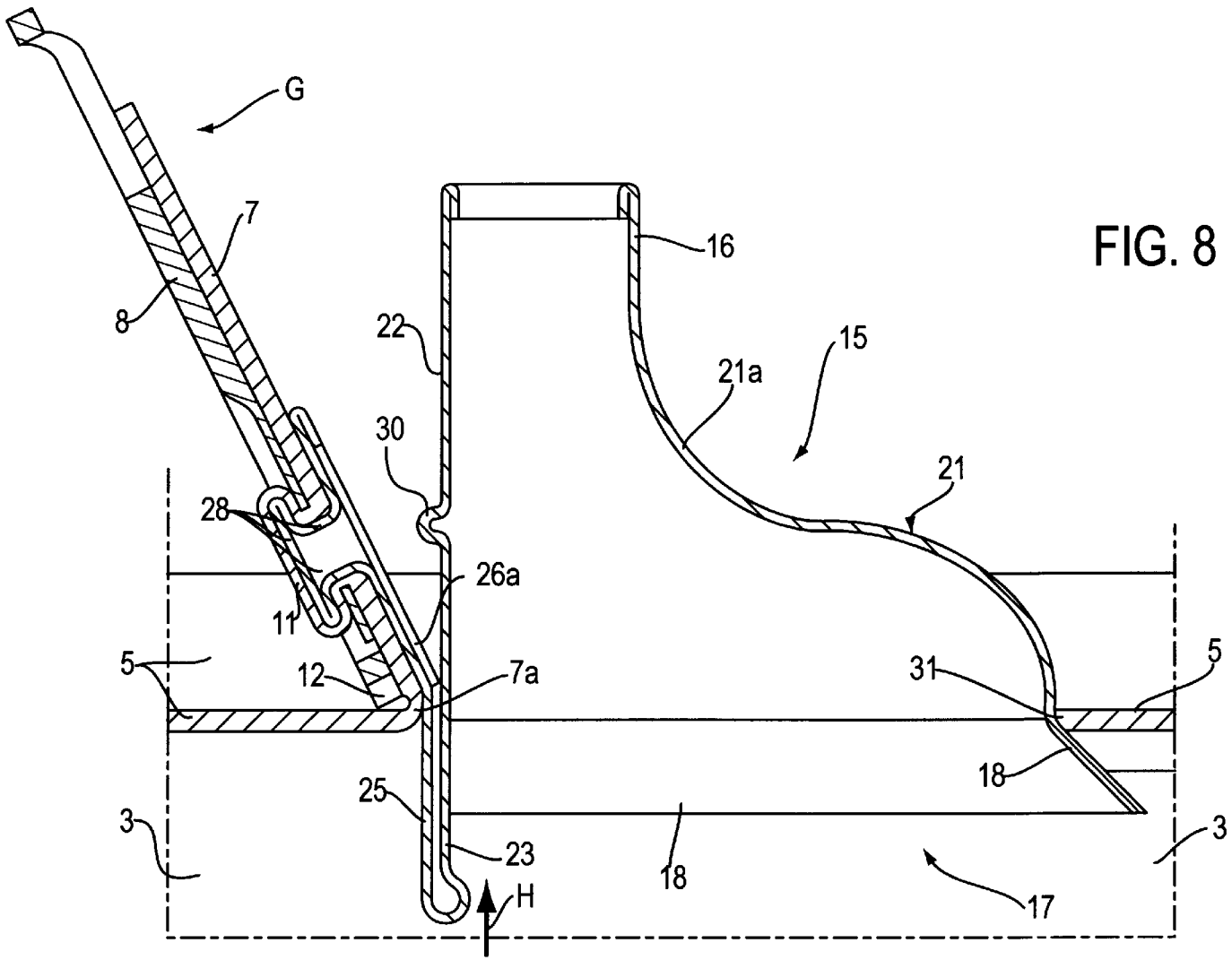
Figure 9:
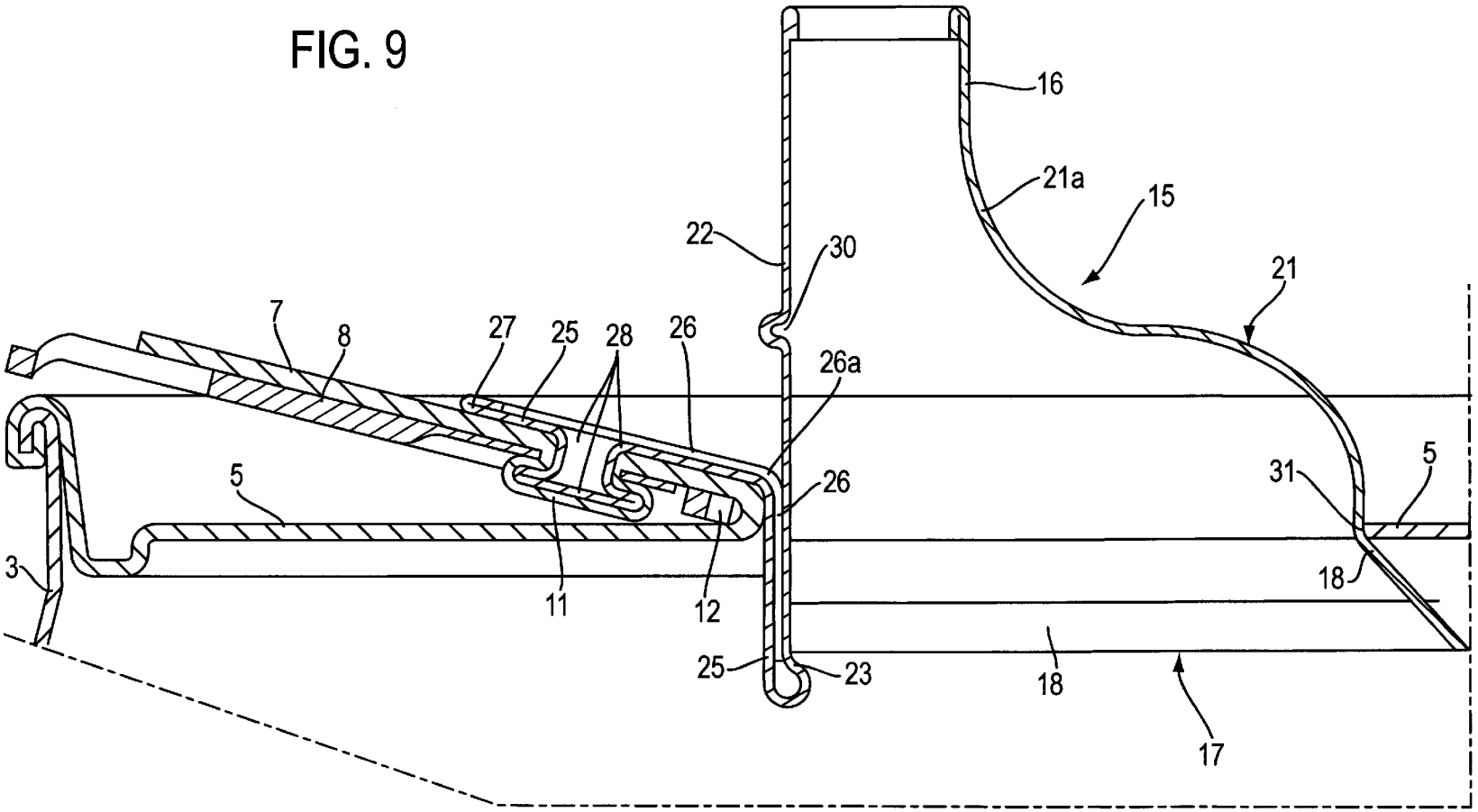
Figure 10:
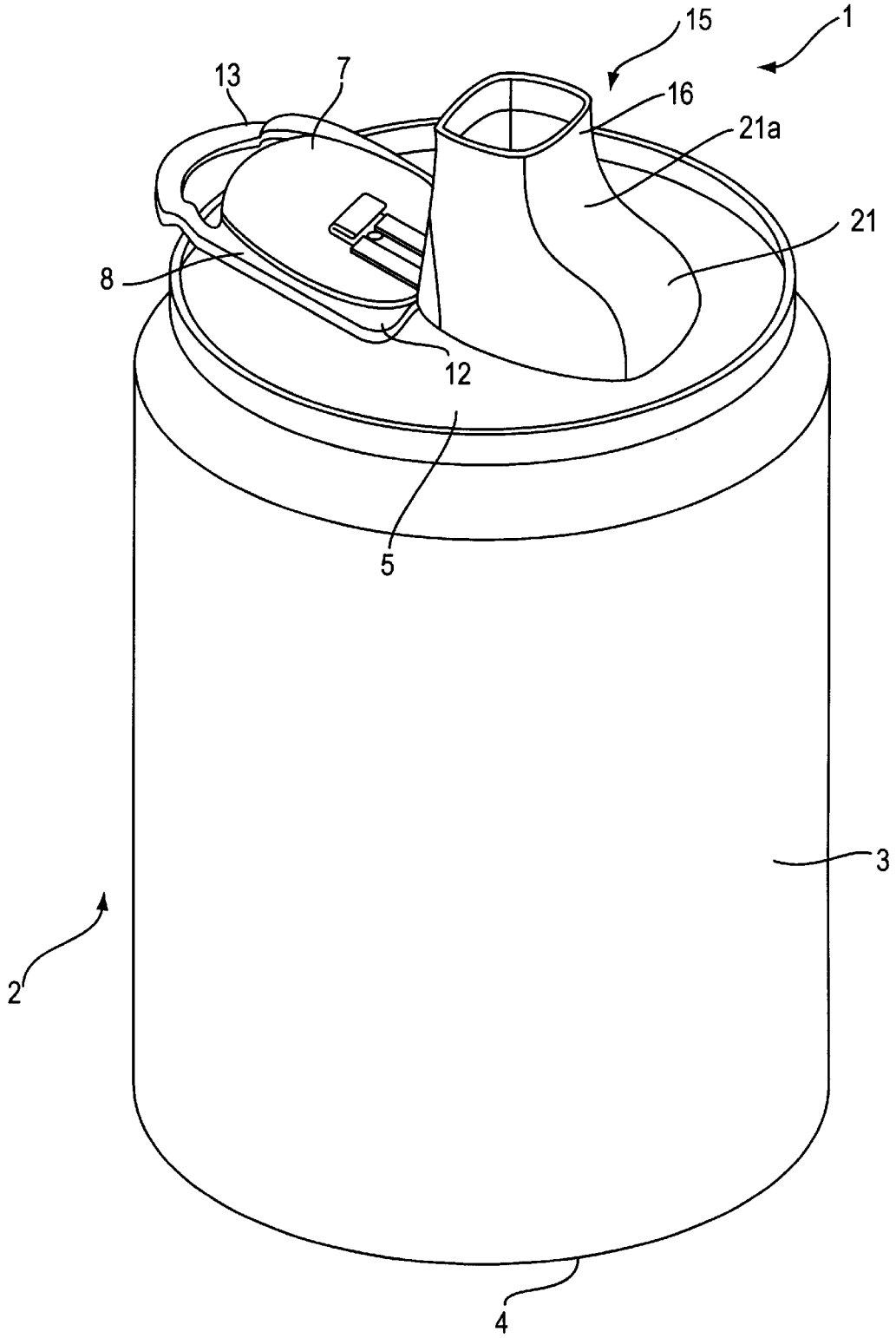
FIG. 10 is a perspective view of a drinks container according to the invention in the open condition ready for use.

The joint pivoting of the lever member 8, the lid 7 and the mouthpiece 15 continues until the end 17 of the mouthpiece 15 abuts the edge of the hole 31 in the top 5 in the region opposite the root 7*a* of the lid 7, as shown in FIG. 7. In this situation, the edge of the hole 31 in the top, in the region opposite the portion 7*a* of the top, is wedged or fitted in the angle formed between the lower end portion of the arcuate wall 21 and the skirt 18 of the mouthpiece. If the lever member 8 is forced to pivot further as indicated by the arrow G in FIG. 8, the bent appendage 19 of the mouthpiece bends in its portion 26*a* which bears on the region of the pivot point of the lid 7 and of the lever 8. Moreover, since the lever member 8 is fairly thick, the point at which the portion 7*a* of the top bends is displaced slightly away from the mouthpiece 15 which pivots on the line of the abutment of its flared portion 18 against the portion of the edge of the hole 31 opposite the root 7*a* of the lid 7 pivoting slightly clockwise as seen in FIG. 8, as indicated by the arrow H in that drawing. As a result of this pivoting, the flared end portion 18 of the mouthpiece 15 is resiliently force-fitted in the hole 31 in the top 5, adopting its final position of use. The pivoting of the lever member 8 can then be continued until the position shown in FIG. 9 is reached.

The mouthpiece 15 as a whole is then force-fitted in the profile of the hole 31 in the top 5.

The user can therefore drink the drink directly, conveniently resting the arcuate surface 21*a* of the portion 21 of the mouthpiece on his lower lip.

The numerous and substantial advantages of the container according to the invention are clear from the foregoing.

This container both prevents the lever member and the lid connected thereto from being scattered in the environment separately, and prevents the drink from contacting external parts or surfaces of the container, ensuring a high degree of hygiene. The mouthpiece also enables the drink to be drunk or poured out very conveniently and easily without the risk of cuts or abrasions.

From the point of view of industrial manufacture, the container according to the invention can easily be produced by simple modifications and additions to the production lines developed for the manufacture of similar containers according to the prior art.

The production of the mouthpiece 15 from the same material as the top 5 and the container 3 or from a material compatible therewith permits complete recycling of the container after use.

Naturally, the principle of the invention remaining the same, the forms of embodiment and details of construction may be varied widely with respect to those described and illustrated purely by way of non-limiting example, without thereby departing from the scope of the invention as defined in the appended claims.

Figure 11:
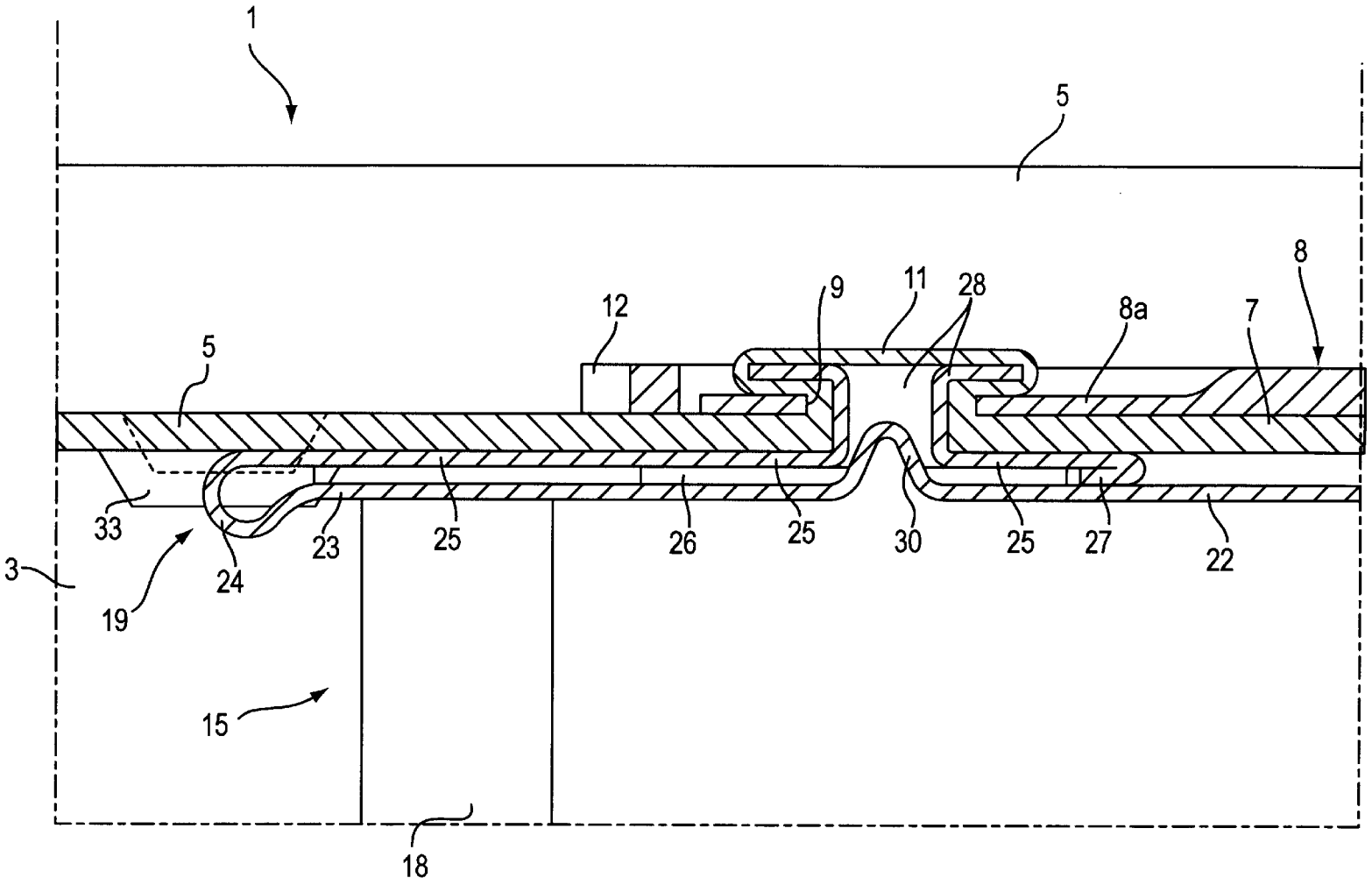
FIG. 11 is a sectioned view showing a variant which is modified with respect to the solution shown in FIG. 2.

In particular, as shown in FIG. 11, the projection 28 of the appendage 19 of the mouthpiece 15 could be of the open-ended type in order to make it easier to upset this projection jointly with the projection 11 of the top 5. Moreover, in order to facilitate the positioning of the mouthpiece relative to the top in order to interconnect them, the top 5 may have locating projections, such as the projection 33 shown in FIG. 11, projecting from its face which is intended to face inwardly of the container. The top 5 could also have further external indentations or projections for locating the lever member 8 and ribs and the like for increasing its stiffness and/or flexibility to achieve the desired effect at the various stages of opening.

The mouthpiece 15 could be of a shape other than that shown and its coupling with the hole formed in the top as a result of the tearing thereof along the weakened line could be fluid-tight or such as to allow air to pass from the atmosphere outside the container to the interior thereof to enable the drink to come out of the container more easily. For this purpose, the mouthpiece 15 could, moreover, have one or more holes formed, for example, in the central lower region of the wall 22.

The connection between the mouthpiece and the top could be formed in other known ways, for example, by welding.

Moreover, although in the currently-preferred version, the container 2, the top 5, and the mouthpiece 15 are advantageously made of a metallic material (such as aluminium, steel, or an alloy thereof), the invention is not, in principle, limited to the use of such a material, since the container may also be made (for example) of plastics material.

As an alternative to the previously described embodiment, the end portions 6*a* of the weakened line 6 might be substantially aligned with each other rather than essentially parallel, and in this case the appendage 19 of mouthpiece 15 would be conveniently disposed in a recess predisposed in wall 22 of the mouthpiece.

In a variant of embodiment, the appendages 12 of the lever member 8 can be replaced or accompanied by projections or ribs provided in the portions 14 of the top member 5. The position of the weakened line 6 and the lever member could be offset with respect to the centre of the top member 5.

Finally, instead of being formed in a single piece by the drawing technique, the container 3 could be made in two pieces (a cylindrical portion and a base) which are connected by a folded seam or in some other way.

What is claimed is:

1. A container (1), particularly for drinks, having an end wall (5) which is weakened along an open line (6) defining the outline of a lid portion (7) and of a corresponding hole (31), a traction member (8) which is connected to the outer face of the end wall (5) of the container (1) and can be operated manually to tear the wall (5) along the weakened line (6) and to displace the lid portion (7) thus formed from the plan of the end wall (5); and a mouthpiece (15) connected to the lid portion (7) of the end wall (5) and disposed inside the container (1), beneath the end wall (5) before the end wall (5) is torn, and capable, after the wall (5) is torn, of being entrained by the traction member (8) and by the lid portion (7) through the corresponding hole (31) formed in said end wall (5) to a position of use in which a distal end (18) of the mouthpiece, which is inside the container (1), abuts said end wall (5);

characterized in that the mouthpiece (15) is provided with an externally bent appendage (19) extending from the distal end (18) towards a mouth end (16) thereof;

said appendage (19) being connected to the lid portion (7);

the traction member being a lever member (8) connected to said lid portion (7) of the end wall (5) so as to be pivotable, together with the lid portion (7) and the mouthpiece (15), about an axis which extends adjacent end portions (6*a*) of the weakened line (6);

the arrangement being such that, after the mouthpiece (15) has reached said position of use, the lever member (8), the lid portion (7) and said appendage (19) are further pivotable away from the mouthpiece (15).

2. A container according to claim 1, wherein the mouthpiece (15) has an essentially tubular shape.

3. A container according to claim 1, characterized in that the mouthpiece (15) is connected to the end wall (5) in a manner such that, before the wall (5) is torn, the mouthpiece (15) is disposed with opposite end openings (16*a*, 18) substantially perpendicular to the wall (5).

4. A container according to claim 1, characterized in the said end portions of the weakened line (6) of the wall (5) are close together and between which there is a portion (7*a*) of the wall (5) which is intended to bend like a hinge to permit an essentially pivoting movement of the lever member (8), of the lid portion (7) and of the mouthpiece (15), after the end wall (5) has been torn.

5. A container according to claim 1 wherein said end portions of said weakened line (6) has its end portions (6*a*) are located in a central portion of the end wall (5), and said weakened line extends from said central portion towards the periphery of said end wall (5).

6. A container according to claim 4, characterized in that the end of the lever member (8) adjacent the ends (6*a*) of the weakened line (6) has a pair of projections (12) for cooperating with regions (14) of the outer surface of the end wall (5) adjacent and outside the weakened line (6) in order to act essentially as pivot points during the pivoting movement of the lever member (8).

7. A container according to claim 1, characterized in that, near the distal end (18) of the mouthpiece which extends into the container (1) in the extracted position of use, the mouthpiece (15) has a portion (20) of shape and size substantially corresponding to the shape and size of the hole (31) which is formed in the end wall (5) as a result of the tearing thereof along the weakened line (6).

8. A container according to claim 7, characterized in that, beyond said portion (20) of the distal end (18) of the mouthpiece (15), the mouthpiece has an outwardly flared skirt (18).

9. A container according to claim 1, in which the lid portion (7) of the end wall (5) has a first projection (11) which extends through a hole (9) in the lever member (8) and is upset like a rivet on the other side of the hole (9) in order to connect the lever member (8) to the lid portion (7) of the wall (5), said appendage having a second projection (28) which is inserted in the first projection (11) of the end wall (5) and through the hole (9) in the lever member (8) and is upset jointly with the first projection (11) in order to connect the mouthpiece (15) to the lever member (8) and to the portion of the end wall (5) of the container.

10. A container according to claim 9, characterized in that the second projection (28) of the portion or appendage (19) of the mouthpiece (15) is closed.

11. A container according to claim 9, characterized in that the second projection (28) of the portion or appendage (19) of the mouthpiece (15) is open.

12. A container according to claim 1 characterized in that the appendage (19) of the mouthpiece (15) has a projection (28) for connection to the lever member (8).

13. A container according to claim 1, characterized in that the appendage (19) of the mouthpiece (15) is of a width substantially corresponding to the distance between the end portions of the weakened line (6) of the end wall (5) of the container.

14. A container according to claim 1 characterized in that the mouthpiece (15) has a side wall (21) which, adjacent the mouth end (16) of the mouthpiece (15), is arcuate and concave externally with a radius of curvature substantially corresponding to the mean radius of a user's lower lip.

15. A container according to claim 1 characterized in that the end wall (5) has a plurality of projections or raised portions (33) projecting from its face which faces inwardly of the container (1) for favouring the precise location of the mouthpiece (15) relative to the end wall (5) during manufacture.

16. A container according to claim 9 characterized in that a reference indentation (30) is provided adjacent the appendage (19) in a wall (22) of the mouthpiece (15) and is aligned with the projection (28) of the appendage (19) in order precisely to locate an opposing tool for the joint plastic deformation of the projection (11) in the end wall (5) of the container and of a projection (28) in the appendage (19) of the mouthpiece (15).

17. A container according to claim 1, characterized in that the container and the mouthpiece (15) are formed of a metallic material (16).

18. A container according to claim 1 comprising a container (3) to one end of which a top (5) is sealingly connected, characterized in that the end wall of the container is constituted by the top (5).

* * * * *